US007024778B2

(12) United States Patent
Kuechler et al.

(10) Patent No.: US 7,024,778 B2
(45) Date of Patent: Apr. 11, 2006

(54) SPLIT END REMOVING DEVICE FOR A HAIRCUTTING MACHINE

(75) Inventors: Robert Kuechler, Moerfelden-Walldorf (DE); Detlef Mattinger, Bickenbach (DE); Karl Trinkaus, Darmstadt (DE)

(73) Assignee: Wella AG, Darmstadt (DE)

( * ) Notice: Subject to any disclaimer, the term of this patent is extended or adjusted under 35 U.S.C. 154(b) by 189 days.

(21) Appl. No.: 10/782,126

(22) Filed: Feb. 19, 2004

(65) Prior Publication Data

US 2004/0172829 A1 Sep. 9, 2004

(30) Foreign Application Priority Data

Feb. 20, 2003 (DE) ..... 103 07 053

(51) Int. Cl.
*B26B 19/00* (2006.01)

(52) U.S. Cl. ..... 30/124; 30/30

(58) Field of Classification Search ..... 30/30, 30/124, 134, 192, 195, 201; 132/213, 225

See application file for complete search history.

(56) References Cited

U.S. PATENT DOCUMENTS

| | | | | |
|---|---|---|---|---|
| 5,884,402 | A | 3/1999 | Talavera | 30/124 |
| 6,588,108 | B1 * | 7/2003 | Talavera | 30/133 |
| 6,883,237 | B1 * | 4/2005 | Klatt et al. | 30/124 |

FOREIGN PATENT DOCUMENTS

DE 101 51 275 A1 5/2002

* cited by examiner

*Primary Examiner*—Hwei-Siu C. Payer
(74) *Attorney, Agent, or Firm*—Michael J. Striker

(57) ABSTRACT

The split end removing device (1) is a removable attachment (3) for a haircutting machine (2). This split end removing device includes first and second parallel hair strand guiding sections (4,5) and a third hair strand guiding section (6) removably positionable in a working position (A) between the first and second sections (4,5). The parallel sections (4,5,6) are formed so that a hair strand (7) placed under the first and second sections (4,5) is grasped from below by the third section (6) in its working position and the attachment (3) is held fixed on the haircutting machine (2) so that only split ends (9) are cut away from the hair strand. The third hair strand guiding section (6) is a separate part (10) that is completely removable from a remaining portion of the device (1). It has a handle section (12), comb teeth (13) and a parting tip (15).

14 Claims, 5 Drawing Sheets

SPLIT END REMOVING DEVICE FOR A HAIRCUTTING MACHINE

BACKGROUND OF THE INVENTION

1. Field of the Invention

The present invention relates to a split end removing device, which is a removable or detachable attachment for a haircutting machine. This split end removing attachment has first and second parallel hair strand guiding sections spaced from each other. A third hair strand guiding section can be positioned in a working position between the first and second hair strand guiding sections. The first, second and third parallel hair strand guiding sections are formed so that a head hair strand placed under the first and second hair strand guiding sections is gripped from below by the third hair strand guiding section and thus has a U-shape. The attachment engages with the haircutting machine so that the cutting head of the haircutting machine is held fixed and only split ends of the hair strand are cut away from the hair strand, when the hair strand is drawn through the hair strand guiding sections.

2. Description of the Related Art

The present invention is based on the split end removing device disclosed in DE 101 51 276 A1. This split end removing device is a releasable or detachable attachment for a haircutting machine. The attachment has first and second hair strand guiding sections, which are arranged parallel to each other and spaced from each other. A third hair strand guiding section is releasably positionable in a working position between the first and second hair strand guiding sections, so that a hair strand positioned under the first and second hair guiding sections is grasped or caught under the third hair guiding section. The hair strand thus has a U-shaped section spaced from the head. The attachment engages on a haircutting machine so that the cutting head of the haircutting machine is fixed in a position relative to the attachment so that only split ends of the hair strand are removed from the hair strand by the cutting head in an upper portion of the third hair strand guiding section when the hair strand is pulled or drawn through the hair strand guiding sections.

SUMMARY OF THE INVENTION

It is an object of the present invention to provide a split end removing device of the above-described kind, which is an attachment for a haircutting machine, which has a simpler structure, is more economical to make and is safer to operate than split end removing devices of the prior art.

This object and others, which will be made more apparent hereinafter, are attained in a split end removing device, which is a removable or detachable attachment for a haircutting machine and which includes first and second parallel hair strand guiding sections spaced from each other with a predetermined spacing and a third hair strand guiding section releasably positionable in a working position between the first and second hair strand guiding sections so as to be parallel to the first and second hair strand guiding sections, wherein the first, second and third parallel hair strand guiding sections are formed so that a head hair strand placed under the first and second hair strand guiding sections is grasped from below by the third hair strand guiding section and thus is approximately U-shaped and the split end removing device has means for releasable attachment to the haircutting machine so that a cutting head of the haircutting machine is held fixed so that only split ends of the hair strand are cut away from the hair strand when the hair strand is drawn through the hair strand guiding sections.

According to the invention the third hair strand guiding section is separate part that is completely removable from the remainder of the split end removing device and has a handle section at a first end thereof.

Because the third hair strand guiding section is a separate part that is completely removable from the remainder of the split end removing device, the third hair strand guiding section can be placed between the first and second hair strand guiding sections in a releasable working position, whereby a U-shaped guide for the head hair strand is produced.

Additional features and embodiments are claimed in the appended dependent claims.

In various preferred embodiments of the invention the third hair strand guiding section includes a comb teeth row and a parting tip at a second end thereof for separating the hair strand from a remaining part of the head hair.

In especially preferred embodiments of the split end removing device retaining means for holding the head hair strand in the vicinity of the third hair strand guiding section in a curved shape when the third hair strand guiding section is in the working position are provided. The retaining means advantageously comprises an elastic or springy guide wall. A hair strand pressing device is preferably arranged on a side of the second hair strand guiding section, which comprises a leaf spring or flat spring element.

Preferably means for removably attaching the third hair strand guiding section to the remaining portion of the split end removing device from the left side or right side thereof according to choice are provided, which comprise catch means for holding the third hair strand guiding section in the working position between the first and second hair strand guiding sections.

In various preferred embodiments the first, second and third hair strand guiding sections are each provided with a smooth surface for minimizing frictional resistance to motion of the hair strand. Preferably the first, second and third hair strand guiding sections are each provided with a round-shaped or circular-shaped cross-section. It is especially advantageous when at least one of the first, second and third hair strand guiding sections comprises a fixed roller or an axially rotatable roller.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
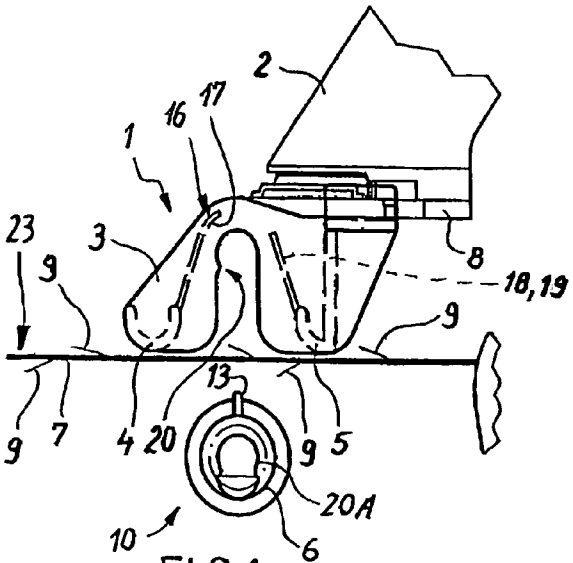
FIG. 1 is a side view of a split end removing device according to the invention connected to a haircutting machine with a third guiding section shown as a separate part together with an uninserted hair strand.
Figure 2:
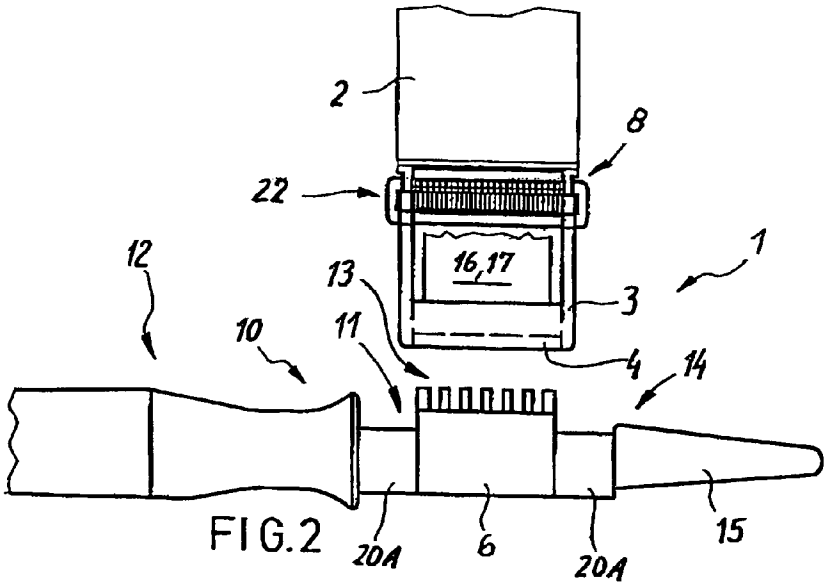
FIG. 2 is a plan view of the split end removing device according to FIG. 1.
Figure 3:
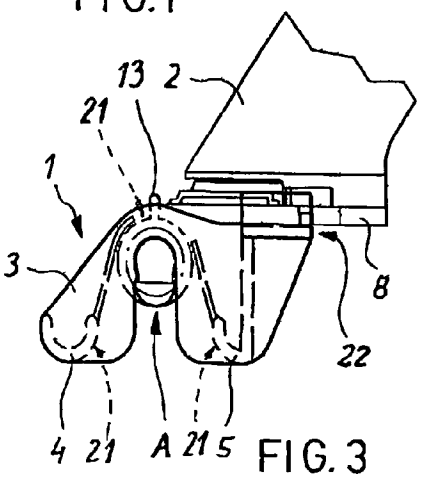
FIG. 3 is a side view of the split end removing device of FIG. 1, but with the third hair strand guiding section formed as a separate part in its working position.
Figure 4:
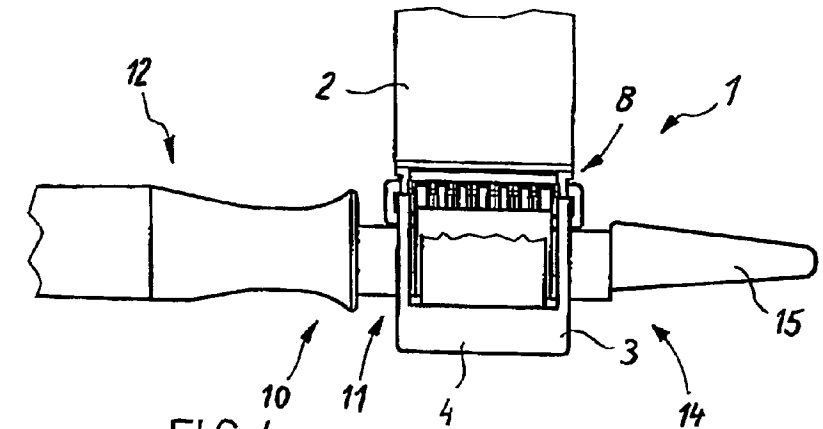
FIG. 4 is a plan view of the split end removing device in its working configuration according to FIG. 3.
Figure 5:
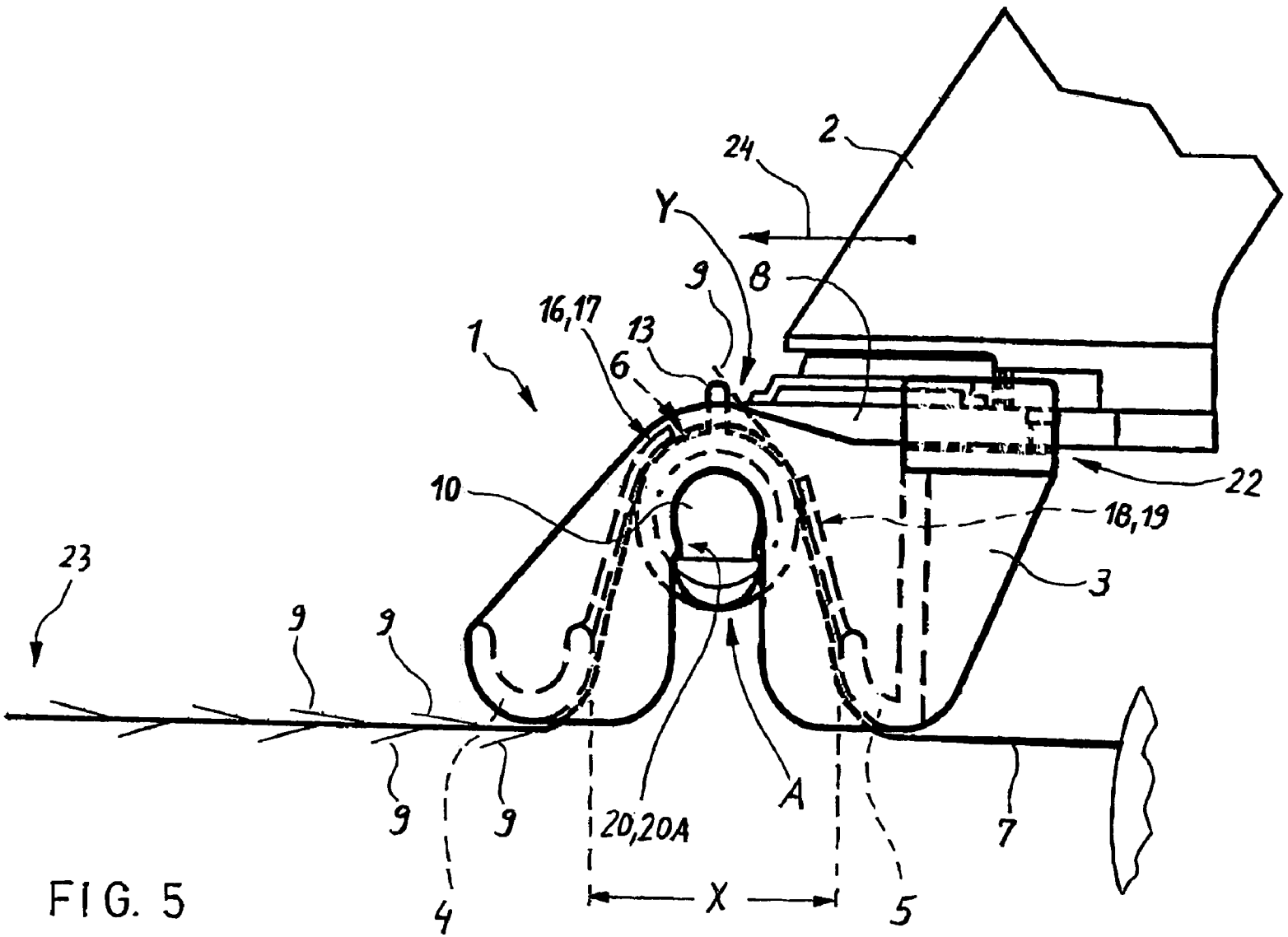
FIG. 5 is a detailed side view of the split end removing device according to FIG. 3 but with an inserted head hair strand, showing the removal of split ends from it.
Figure 6:
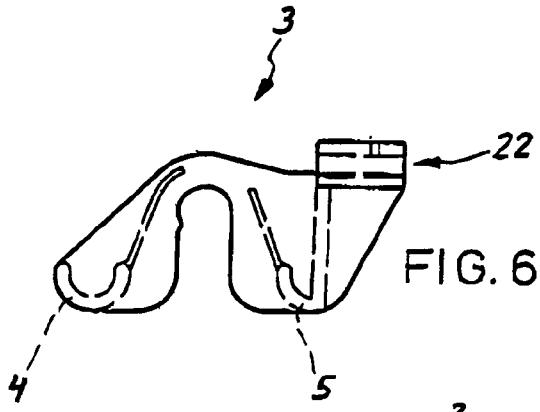
FIGS. 6 to 9 are respective side and plan views of the split end removing device without the separate part consisting of the third hair strand guiding section and without the haircutting machine.
Figure 7:
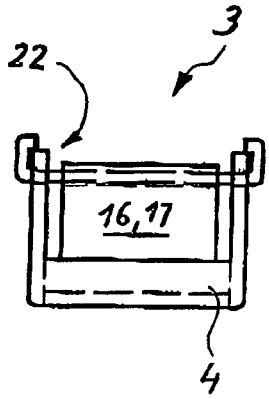
Figure 8:
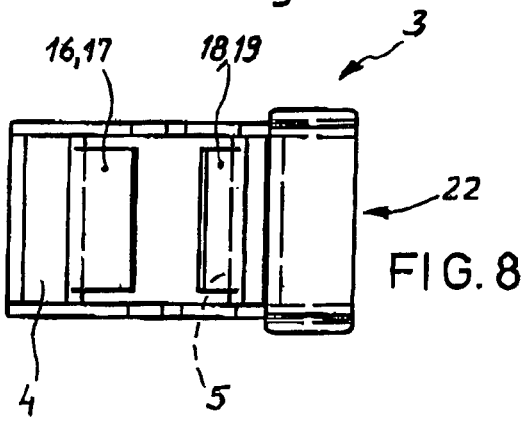
Figure 9:
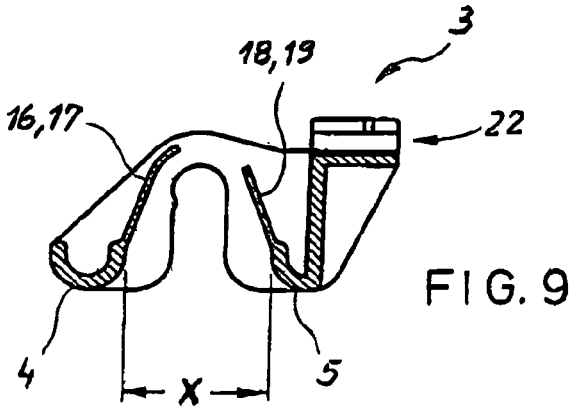
Figure 10:
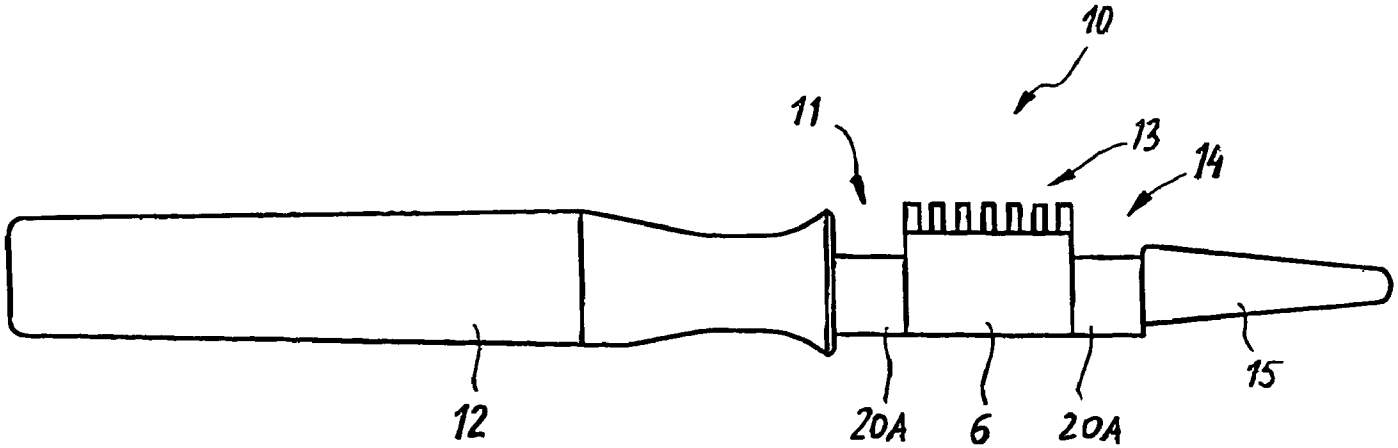
FIGS. 10 to 12 are different views of the separate part consisting of the third hair strand guiding section according to the invention.
Figure 12:
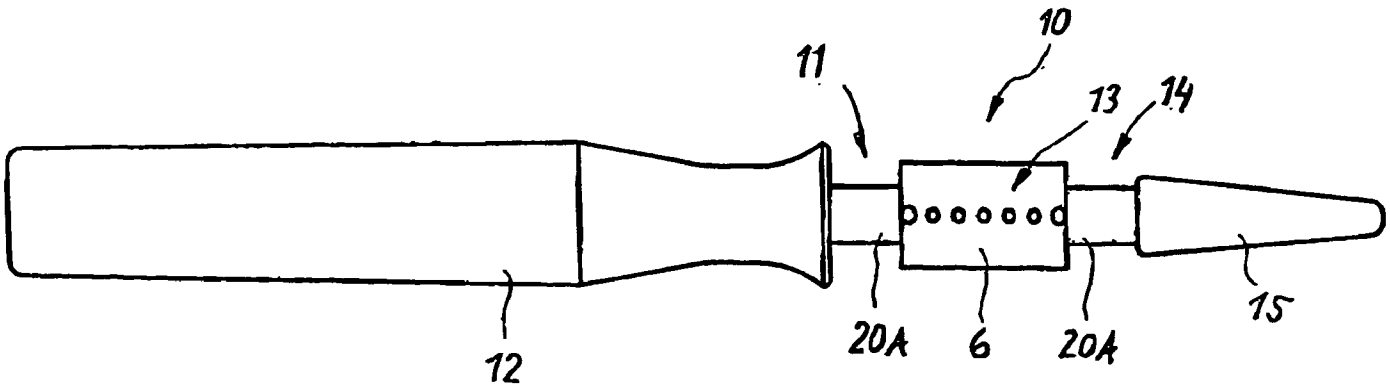
Figure 11:
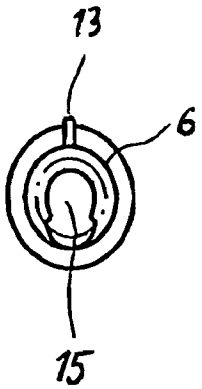

FIGS. 1 to 5, especially FIG. 5, shows a split end removing device 1, which is formed as a removable attachment 3 for an electrical haircutting machine 2. The attachment 3 has first and second hair strand guiding sections 4,5, which are parallel and spaced a distance X from each other. A third hair strand guiding section 6 is removably or releasably positionable in a working position A between the first and second hair strand guiding sections 4,5 parallel to the first and said hair strand guiding sections 4,5. Thus a head hair strand 7 positioned under the first and second hair strand guiding sections 4,5 is caught or grasped from below by the third hair strand guiding section 6 so as to be approximately U-shaped. When the split end removing device 1 is engaged with a haircutting machine 2, a cutting head 8 of the haircutting machine 2 is held in a fixed position in relation to the split end removing device 1. Because of that only split ends 9 of the hair strand are cutaway by the cutting head 8 in an upper region Y of the third hair strand guiding device 6 when the head hair strand 7 is pulled or drawn through the hair strand guiding sections 4,5,6. The third hair strand guiding section 6 is a separate part 10 that is completely removable from the remaining portion of the split end removing device 1. It is provided with a handle section 12 at a first end 11. This third hair strand guiding section 6 is inserted between a first and second hair strand guiding device 4,5 for positioning in a working position A, whereby a U-shaped guide for the head hair strand is formed. Only the split ends 9 are cut away in the upper region Y of the third hair strand guiding section 6 when the haircutting machine 2 is moved in the motion direction 24 along the hair strand 7 toward its end.

For separating a head hair strand 7 from the remainder of the head hair the separate part 10 is provided with a parting tip 15 for combing or parting the head hair strand 7 at a second end 14 of the section 6. The separate part 10 is also provided with a row 13 of comb teeth for combining through the hair strand.

The apparatus 1 is provided with a retaining means 16 for holding a curved hair strand 7 in the working position A on the upper region Y of the third hair strand guiding section 6. The retaining means 16 comprises a springy or elastic guide wall 17. Because of that an unwanted cutting away of springy hair tips at the end 23 of the hair strand 7 is prevented.

A hair strand pressing device 18 is provided on the side of the second hair strand guiding section 5. This hair strand pressing device 18 comprises a leaf spring 19. This hair strand pressing device 18 acts to stretch the hair strand passing through the device taut, so that only the protruding split ends 9 of the hair strand are cutaway by the cutting head 8.

In the working position A the third hair strand guiding section 6 formed as separate part 10 is constructed so that it is releasably attachable arbitrarily from the right or left side with a remaining portion of the attachment 3 or the split end removing device 1. The split end removing device 1 is provided with catch device 20,20A for this purpose, i.e. for releasable attachment of the third hair strand guiding section 6 in its working position.

The first, second and third hair strand guiding sections 4,5 and 6 are each provided with a smooth surface 21, so that the pulling or drawing of the head hair strand through the device is opposed by minimal frictional resistance. Manufacturing methods advantageously benefit when the first, second and third hair strand guiding sections 4, 5 and 6 are each provided with a partially circular or round cross-section.

Figure 13:
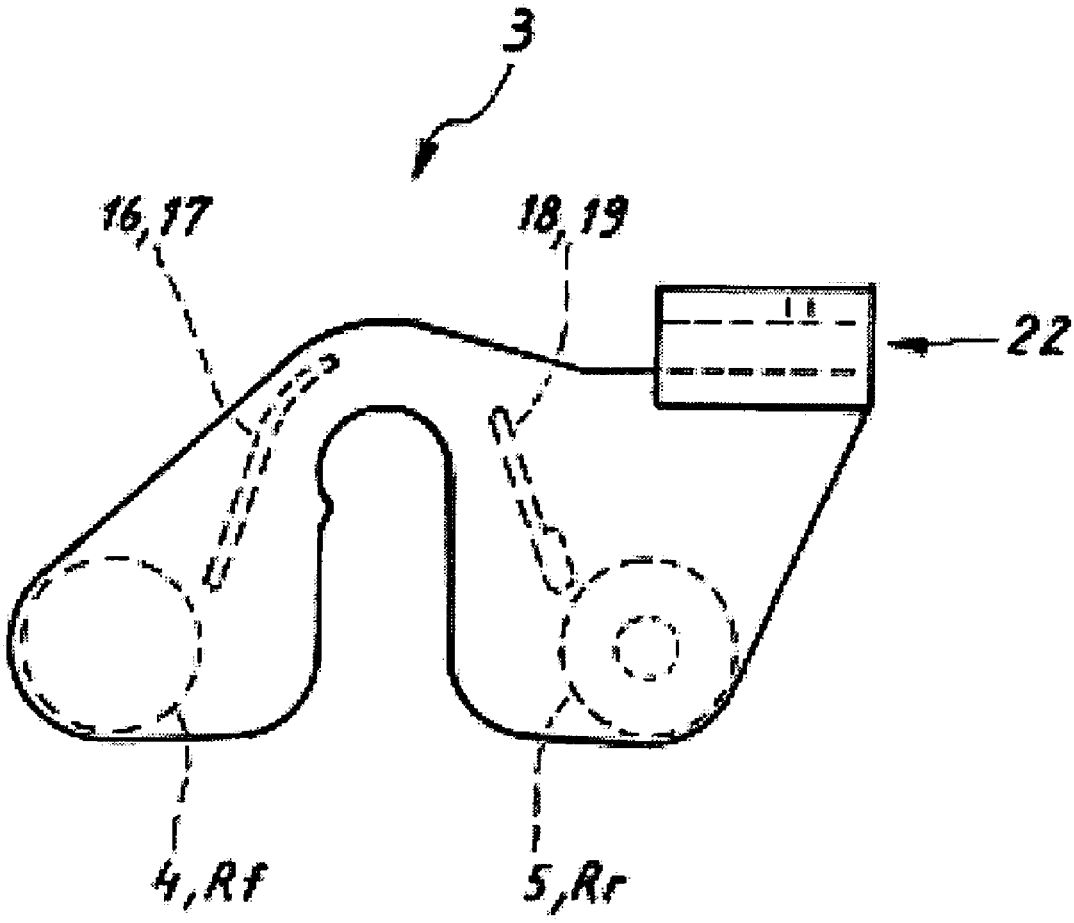
FIG. 13 is a detailed side view of an alternative embodiment for the split end removing device according to the invention without the third hair strand guiding section and without the haircutting machine.

In an alternative embodiment of the split end removing device 1 according to the invention the first, second and third hair strand guiding section 4, 5, 6 each can comprise either a fixed roller Rf or an axially rotatable roller Rr arbitrarily or according to choice. This embodiment, which is shown in part in FIG. 13, minimizes frictional resistance to the pulling or drawing of the hair strand 7 through the split end removing device when it is attached with the hair cutting device 2. The same or similar parts performing the same or similar function in this embodiment shown in FIG. 13 are provided with the same reference numbers as in the embodiment of FIGS. 1 to 12.

The attachment 3 may be made in part from a plastic material, with the exception of the third hair strand guiding section 6, so that manufacture is especially economical.

The attachment 3 is provided with a receptacle 22 for releasable attachment with the cutting head 8 of the haircutting machine 2. Because of that the haircutting machine 2 can be used for conventional hair cutting and also for cutting away split ends, arbitrarily or according to choice.

Different views of the split end cutting device 1 without the separate part 10 and without the haircutting machine 2 are shown in FIGS. 6 to 9 for improved illustration.

The method of removing split ends with the split end removing device 1 according to the invention comprises the following steps.

1. A head hair strand 7 is separated from the remainder of the hair with the parting tip 15 of the separate part 10.

2. The head hair strand 7 is combed with the row 13 of the comb teeth 13.

3. The hair roots of the head hair strand 7 are placed on both hair strand guiding sections 4,5, the head hair strand 7 is grasped with the separate part 10 from below and the separate part 10 is put in the working position A.

4. Then the split end removing device 1 with the attached hair cutting machine 2 is moved along the head hair strand 7 in the motion direction 24 or the hair strand 7 is pulled through the device by moving the device from the hair roots toward the hair tips, which can be performed as many times as necessary in order to obtain the optimum split end removal result.

5. The next hair strands are handled in the same manner as in steps 1 to 4.

The disclosure in German Patent Application 103 07 053.2-15 of Feb. 20, 2003 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a split end removing device for a haircutting machine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A split end removing device (1) consisting of a removable attachment (3) for a haircutting machine (2), said split end removing device comprising first and second parallel hair strand guiding sections (4,5) spaced from each other with a spacing (X);

a third hair strand guiding section (6) releasably positionable in a working position (A) between the first and second hair strand guiding sections (4,5) parallel to the first and second hair strand guiding sections (4,5), wherein said first, second and third parallel hair strand guiding sections (4,5,6) are formed so that a head hair strand (7) placed under the first and second hair strand guiding sections (4,5) is grasped from below by the third hair strand guiding section (6) in said working position so that said hair strand is approximately U-shaped; and means for releasable attachment to said haircutting machine (2) so that a cutting head (8) of the haircutting machine (2) is held fixed so that only split ends (9) of the hair strand (7) are cut away from the hair strand (7) when the hair strand (7) is drawn through said hair strand guiding sections (4,5,6);

wherein the third hair strand guiding section (6) is a separate part (10) that is completely removable from a remaining portion of the split end removing device (1) and the third hair strand guiding section (6) includes a handle section (12) at a first end (11) of the third hair strand guiding section (6).

2. The split end removing device as defined in claim 1, wherein said third hair strand guiding section (6) includes a row (13) of comb teeth.

3. The split end removing device as defined in claim 1, wherein said third hair strand guiding section (6) includes a parting tip (15) at a second end (14) of said third hair strand guiding section (6).

4. The split end removing device as defined in claim 1, further comprising retaining means (16) for holding the head hair strand (7) in the vicinity of the third hair strand guiding section (6) in a curved shape when said third hair strand guiding section is in the working position (A).

5. The split end removing device as defined in claim 4, wherein said retaining means (16) comprises an elastic or springy guide wall (17).

6. The split end removing device as defined in claim 1, further comprising a strand pressing device (18) on a side of the second hair strand guiding section (5).

7. The split end removing device as defined in claim 6, wherein said strand pressing device (18) comprises a leaf spring or flat spring element (19).

8. The split end removing device as defined in claim 1, further comprising means for removably attaching said third hair strand guiding device (6) from a left side or right side thereof with said remaining portion.

9. The split end removing device as defined in claim 8, wherein said means for removably attaching comprises catch means (20,20A), which holds the third hair strand guiding section (6) in the working position (A).

10. The split end removing device as defined in claim 1, wherein said first, second and third hair strand guiding sections (4,5,6) are each provided with a smooth surface (21) for minimizing frictional resistance.

11. The split end removing device as defined in claim 1, wherein said first, second and third hair strand guiding sections (4,5,6) are each provided with a round-shaped or circular-shaped cross-section.

12. The split end removing device as defined in claim 1, wherein at least one of said first, second and third hair strand guiding sections (4,5,6) comprise a fixed roller (Rf) or an axially rotatable roller (Rr).

13. The split end removing device as defined in claim 1, wherein said remaining portion consists of a one-piece plastic part.

14. The split end removing device as defined in claim 1, wherein said means for releasable attachment with the hair cutting machine (2) comprises receptacle (22) in said remaining portion.

* * * * *